US005901484A

United States Patent [19]

Seder

[11] Patent Number: 5,901,484

[45] Date of Patent: May 11, 1999

[54] MANUALLY OPERATED MOVEABLE DISPLAY DEVICE

[76] Inventor: Rufus Butler Seder, 50 Terminal St., Bldg. 2, Ste. 703, Charlestown, Mass. 02129

[21] Appl. No.: 09/094,337

[22] Filed: Jun. 9, 1998

[51] Int. Cl.[6] ..... G09F 7/00

[52] U.S. Cl. ..... 40/488; 40/445

[58] Field of Search ..... 40/375, 445, 488, 40/491; 434/405

[56] References Cited

U.S. PATENT DOCUMENTS

| | | | |
|---|---|---|---|
| Re. 13,109 | 5/1910 | Spiegel . | |
| 829,492 | 8/1906 | Spiegel . | |
| 1,259,297 | 3/1918 | Russell | 40/445 |
| 1,285,753 | 11/1918 | Löwenstein . | |
| 1,474,572 | 11/1923 | Whitstock | 40/445 |
| 2,085,803 | 2/1937 | Harrison | 40/445 |
| 2,182,325 | 12/1939 | Tucker . | |
| 2,367,967 | 1/1945 | Schwartz | 40/445 |
| 2,398,257 | 4/1946 | Schwartz | 40/445 |
| 2,482,947 | 9/1949 | Swarbrick . | |
| 2,528,765 | 11/1950 | Lindberg, Jr. . | |
| 2,645,047 | 7/1953 | O'Gorman . | |
| 3,000,125 | 9/1961 | Elvestrom . | |
| 3,082,560 | 3/1963 | Elvestrom . | |
| 3,484,969 | 12/1969 | Newland . | |
| 3,862,504 | 1/1975 | Ringelheim et al. . | |
| 4,118,879 | 10/1978 | Simon | 40/437 |
| 4,622,769 | 11/1986 | Friedman . | |
| 4,789,573 | 12/1988 | Jenkinson | 428/28 |
| 5,197,886 | 3/1993 | Sekiguchi . | |
| 5,588,526 | 12/1996 | Fantone et al. . | |
| 5,695,346 | 12/1997 | Sekiguchi et al. . | |

*Primary Examiner*—Joanne Silbermann
*Attorney, Agent, or Firm*—O'Connell Law Firm

[57] ABSTRACT

A manually operated moveable display device for displaying a plurality of images comprising an image member with an inage panel slidably retained adjacent to a shutter panel of a shutter member. A plurality of coded images are disposed on the image panel, a plurality of shutter elements are disposed on the shutter panel in alignment with the coded images, and a plurality of viewing elements are interposed between the plurality of shutter elements. The device maintains the first edge of the image panel and the first edge of the shutter panel in a substantially parallel relationship, the second edge of the image panel and the second edge of the shutter panel in a substantially parallel relationship, the image panel of the image member and the shutter panel of the shutter member in a bowed condition, and the image panel and the shutter panel of the shutter member in contact. The moveable display device may comprise most preferably a first bowed sleeve slidably surrounded in close frictional contact by a second bowed sleeve with coded images disposed on a front panel of the first bowed sleeve and shutter elements and viewing elements disposed on a front panel of the second bowed sleeve. The first and second bowed sleeves may be formed for precise registration and size by use of registration points disposed adjacent to the corners of first and second flexible sheets from which the first and second bowed sleeves are formed.

20 Claims, 4 Drawing Sheets

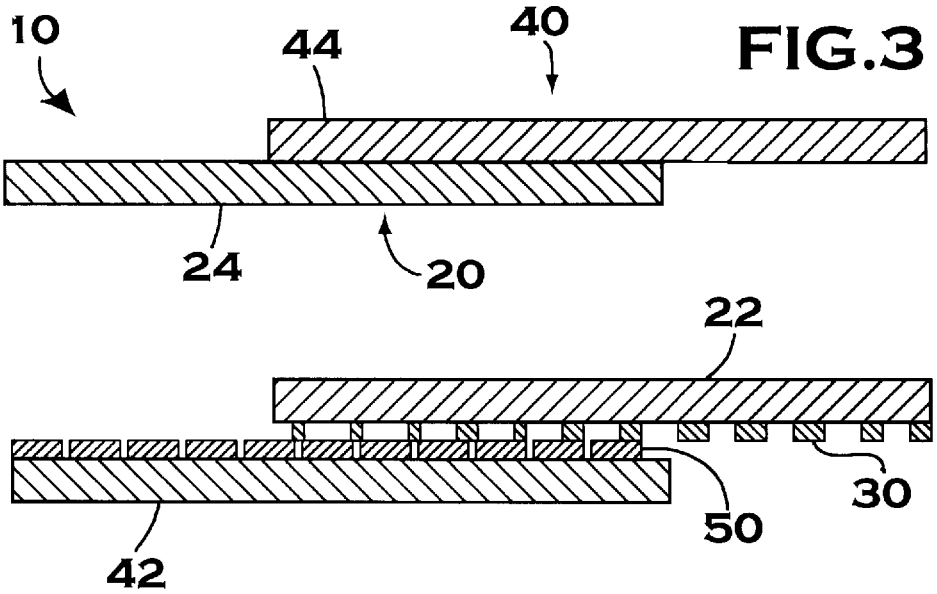
FIG.3
FIG.4
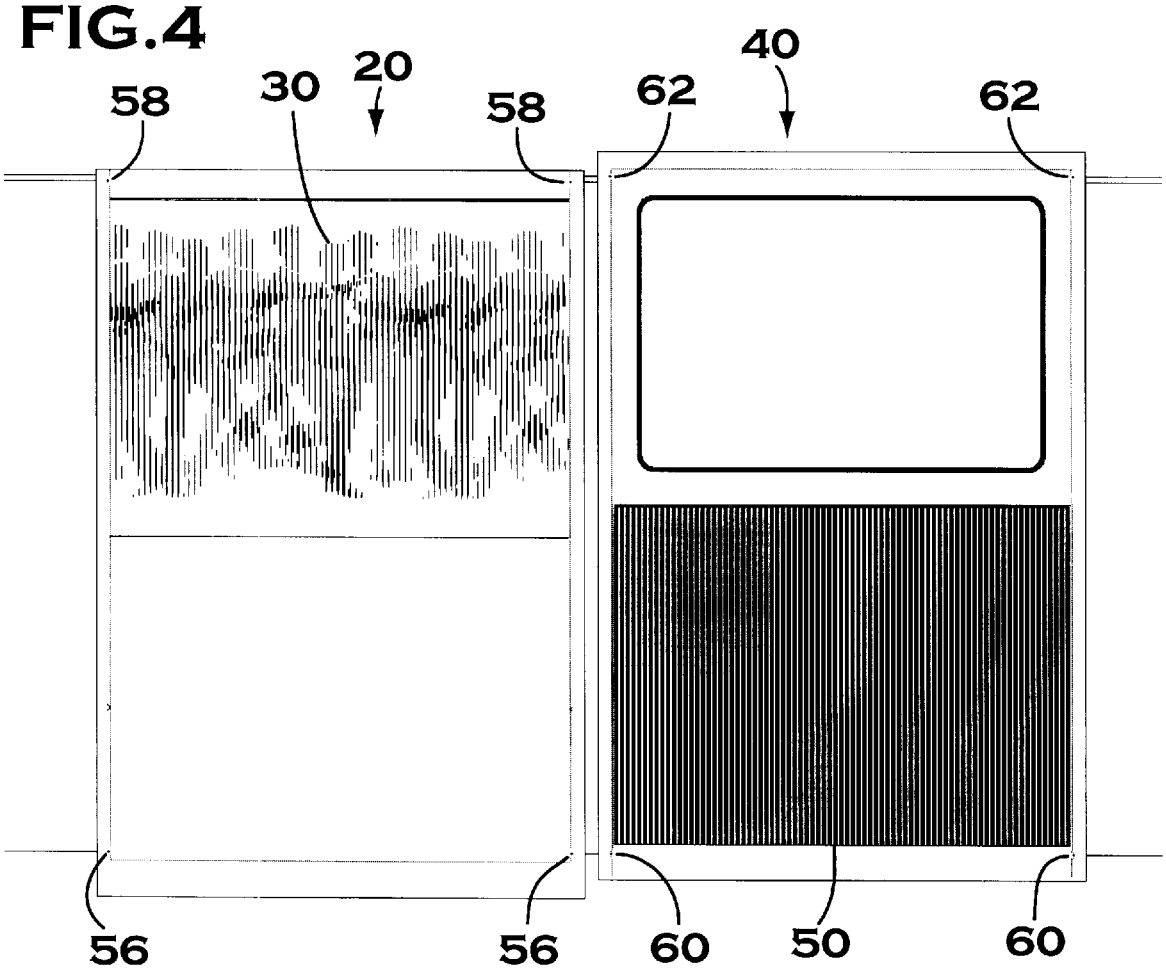

MANUALLY OPERATED MOVEABLE DISPLAY DEVICE

FIELD OF THE INVENTION

The present invention relates generally to display devices. More particularly, disclosed herein is a manually operated moveable display device for displaying a plurality of images in response to relative movement of a shutter member relative to an image member.

BACKGROUND OF THE INVENTION

Since at least as early as the year 1906, devices permitting the sequential display of a plurality of coded images by relative movement of an image member relative to a shutter member have been known to the art. Based on the nature of their operation, such devices may be termed moveable display devices.

Most basically stated, such moveable display devices comprise an image member slidably retained adjacent to a shutter member. The image member has a plurality of interposed coded images disposed thereon. One looking at the image member separated from the shutter member would see the plurality of interposed coded images as apparently incoherent narrow strips or, possibly, dots, and the coded images would not be likely to be dearly cognizable.

The shutter member has a plurality of ideally opaque shutter elements disposed thereon that are separated by a plurality of translucent, ideally transparent, viewing elements. Certainly the prior art has made dear that the plurality of shutter elements may assume a wide variety of shapes including straight bars, curving bars, apertured opaque portions, and any other functioning configuration. Naturally, the shapes of the coded images would correspond to the shapes of the shutter elements. The plurality of viewing elements could comprise open slots, transparent bars, or any other means that would allow a selective viewing of the coded images.

It is worth noting that it is most common for the plurality of shutter elements to comprise straight opaque bars of ink or the like printed on a transparent substrate and for the plurality of viewing elements to comprise interposed portions that are devoid of ink. Accordingly, the present discussion will continue under the assumption that the shutter elements and the viewing elements are so formed but with the proviso that such need not necessarily be the case.

In intended operation, the plurality of shutter elements perform dual, equally critical functions. By their opaque nature, the shutter elements selectively block from view all but one of the plurality of interposed coded images. Accordingly, the image that is not blocked may be termed an active image. Just as importantly, however, the plurality of shutter elements bridge the gaps between the coded strips that comprise the active image. With this, the plurality of shutter elements uncode the active image of the plurality of coded images, and the active image appears to be complete.

When the image member and the shutter member are moved relative to each other a predetermined amount, the strips of the previously active image are concealed, and the next succeeding coded image assumes the fleeting position as an active image. This procedure will continue through a cycle comprising the number of coded images that are disposed on the image member whereupon the first coded image will again appear thereby signaling the start of a new, identical cycle.

The very astute observer will realize that the number of coded images that a moveable display device is able to display in a cycle is mathematically limited by the width of the shutter element relative to the width of the strips that comprise the coded images. Stated more particularly, the number of coded images cannot exceed one plus the result of the width of each shutter element divided by the width of each strip of the coded images. In the aforedescribed formula, the number one represents the active image while the result of dividing the width of each shutter element by the width of each strip of the coded images represents the number of images concealed by the shutter elements at any one time.

For a number of obvious reasons, there has been a recognized and long felt need in this art to provide a moveable display device that is capable of displaying an increased plurality of images. In light of the simple formula set forth above, it is readily apparent that an increase in the number of displayed images can be accomplished by increasing the number of the plurality of coded images concealed behind each individual shutter element, or, more specifically, by increasing the number of coded image strips concealed behind each individual shutter element.

To conceal an increased number of coded image strips behind each individual shutter element, one might increase the overall width of each shutter element. However, to maintain a display of relatively high image resolution, one widening each shutter element would be required to increase the physical size of the display itself. In most cases involving hand held moveable display devices, increasing the size of the display device would be impractical Therefore, to increase the number of displayed images while maintaining an image of high resolution in a display device of a preferred physical size, it is preferable instead to narrow the overall width of the coded image strips while substantially maintaining the original width of the concealing shutter elements. Unfortunately, however, this preferred solution presents a plurality of practical problems at least in part because it necessitates that the width of the viewing elements be proportionately narrowed.

For example, a narrowing of the viewing elements results in a proportional increase for the need for precise registration between the coded images and the shutter elements, including during relative movement therebetween. In other words, where the strips of the coded images are very narrow, even a slight misalignment will destroy the device's ability to display coherent images. Furthermore, as the width of the strips narrows, the need for maintaining the coded images and the shutter elements in dose contact over their entire surfaces also increases proportionally. With very narrow strips of the coded images, even a very slight gap between the coded images and the shutter elements would ruin the clarity of the displayed images except from a perfectly perpendicular viewpoint, and even then true clarity might require that a user view the display device using only one eye.

For many decades, maintaining precise registration and dose contact between the shutter elements and the coded images in image display devices has been a recognized need and an explicit goal of a multiplicity of inventors. However, the proposed solutions of these inventors have proven to be undesirably complex, cumbersome, and, in some cases, of dubious effectiveness.

Relative to manually operated display devices, the inventor W. S. Russell recognized this need. In U.S. Pat. No. 1,259,297 for a Picture Display Holder, which issued in 1918, Russell attempted to provide a means for registering the shutter elements and the coded images in the form of gage marks on the shutter member and the image member that a user was expected to maintain in accurate registration merely by finger pressure. One must suspect that such a registering means would be vulnerable to misalignment particularly during movement, even with relatively wide coded image strips. Such limitations have continued to limit the number of images that manually operated moveable display devices are able to display effectively. Consequently, it appears that even in the most well made devices it has proven impracticable to display any more than four images effectively.

The need for accurate registration and close contact between coded images and shutter elements again was attempted to be addressed in the 1961 U.S. Pat. No. 3,000,125 to Elvestrom for a Pictorial Display Device. In that patent, Elvestrom revealed a complex arrangement of brackets and an adjustable nut and screw combination for maintaining and adjusting the alignment of his shutter elements and coded images. After describing this complex arrangement in detail, he writes, "Only a moderate amount of experimentation is required to achieve this desired setting." Without speaking to the effectiveness of the device, it must be said that requiring such a complex arrangement and the active involvement and expertise of a user certainly is less than ideal.

Still another attempt to provide a moveable display device that maintains full surface contact and accurate registration of a shutter member relative to an image member is found in the 1975 U.S. Pat. No. 3,862,504 to Ringelheim, deceased, et al. for a Visual Display Apparatus. In a telling manner, the patent declares tat, "the inability to maintain precise alignment" of the shutter elements and the coded images is a problem that has interfered with the commercial adoption of moveable display devices. Ringelheim also laments the need for maintaining close surface contact between the surfaces of the shutter member and the image member in moveable display devices. Having said these things, the inventor goes on to disclose a complex coil spring and cam follower arrangement that is said to maintain intimate surface contact and precise alignment of the shutter member relative to the image member.

With such a knowledge of the state of the art at hand, it becomes dear that a moveable display device capable of maintaining an image member and a shutter member in constantly dose contact and in exceedingly accurate registration certainly would be useful. However, a manually operated moveable display device able to maintain continuously close contact and accurate registration between an image member and a shutter member while being exceedingly simple in use, structure, and manufacture undoubtedly would represent a marked advance in the art.

SUMMARY OF THE INVENTION

Advantageously, the present invention for a moveable display device is founded upon a principal object of providing a moveable display device that maintains exceptionally accurate registration and exceedingly constantly close contact of a plurality of shutter elements relative to a plurality of coded images.

A resultant object of the invention is to craft a moveable display device that is capable of displaying a large plurality of sharp and intricate images that change from one to another in a fluidic manner.

A further object of the invention is to provide such a moveable display device that is hand held and manually operable.

Yet another object of the invention is to accomplish these goals in a moveable display device that is exceedingly simple in use, structure, and manufacture.

Still another object of this invention is to provide a moveable display device that is compressible to a flat configuration and that allows a user to apply messages and the like thereto whereby the device can be employed as a greeting card or the like.

Certainly these and other objects and advantages of the invention will be readily apparent to one who reviews the present specification and drawings and also to one who has the opportunity to enjoy the use of an embodiment of the present invention.

In accomplishing the aforementioned objects, the present invention for a manually operated moveable display device essentially includes an image member and a shutter member. A plurality of interposed coded images are disposed on an image panel of the image member, a plurality of shutter elements are disposed on a shutter panel of a shutter member in alignment with the coded images on the image panel of the image member, and a plurality of viewing elements are interposed between the plurality of shutter elements. The shutter panel of the shutter member is slidably retained adjacent to the image panel of the image member. With this, the shutter elements selectively obscure all but one of the coded images on the image panel of the image member while completing the one coded image that is not obscured as it is selectively exposed by the viewing elements.

The invention is further improved by the inclusion of a means for maintaining a first edge of the image panel of the image member and a first edge of the shutter panel of the shutter member in a substantially parallel relationship, and a means for maintaining a second edge of the image panel of the image member and a second edge of the shutter panel of the shutter member in a substantially parallel relationship. Also preferably included is a means for biasing the image panel of the image member and the shutter panel of the shutter member into a bowed condition with a bow generally perpendicular to the first and second edges of the image panel and the shutter panel whereby either the image panel or the shutter panel comprises an inner panel and the other panel comprises an outer panel. The invention's effectiveness is improved still further by the inclusion of a means for biasing the image panel of the image member and the shutter panel of the shutter member into contact Even under this most basic embodiment, the manually operated moveable display device is capable of displaying a plurality of coded images in response to a movement of the shutter panel relative to the image panel while simultaneously maintaining the coded images and the shutter elements in accurate registration.

In preferred embodiments, the means for biasing the image panel and the shutter panel into contact comprises a means for applying a constant force to at least a portion of the first edge and the second edge of the inner panel thereby to press the inner panel into constant contact with the outer panel. This means for applying a constant force may comprise a first restrictive member, such as a shoulder of a given length, projecting from the first edge of the outer panel immediately distal to the first edge of the inner panel and a second restrictive member, such as a shoulder of a given length, projecting from the second edge of the outer panel immediately distal to the second edge of the inner panel such that the first and second restrictive members trap the inner member to exert a constant compressive force on the inner panel to bias the inner panel into constant close contact with the outer panel.

In a most simple embodiment, the outer panel may be generally rigid so that it comprises the means for biasing the image panel of the image member and the shutter panel of the shutter member into a bowed condition. In other embodiments, the manually-operated moveable display device may further comprise a rear panel with a first edge coupled to the first edge of the outer panel to form a first smooth hinge joint and a second edge coupled to the second edge of the outer panel to form a second smooth hinge joint. Under this arrangement, the moveable display device may further comprise a means for biasing the rear panel into a bowed condition. With this, the outer panel and the rear panel together form a sleeve that surrounds the inner panel, and the first and second smooth hinge joints and the rear panel comprise the first and second restrictive members.

In a most simple manner, the first and second smooth hinge joints may be biased toward an open condition merely due to their own material properties so that they comprise the means for biasing the image panel of the image member and the shutter panel of the shutter member into a bowed condition and the means for biasing the rear panel into a bowed condition. Alternatively or additionally, the means for biasing the image panel of the image member and the shutter panel of the shutter member into a bowed condition and the means for biasing the rear panel into a bowed condition may comprise a first resilient wedge of, for example, plastic tape disposed adjacent to tile first smooth hinge joint and a second resilient wedge disposed adjacent to the second smooth hinge joint. Still further, the biasing means could comprise a spring member interposed between the inner panel and the rear panel.

The present invention may be embodied most uniquely in a manually-operated moveable display device that comprises a first bowed sleeve with a bowed front panel coupled at a first edge to a first edge of a bowed rear panel to form a first smooth hinge joint and coupled at a second edge to a second edge of the bowed rear panel to form a second smooth hinge joint. A second bowed sleeve slidably surrounds the first bowed sleeve and has a bowed front panel coupled at a first edge to a first edge of a bowed rear panel to form a first smooth hinge joint and coupled at a second edge to a second edge of the bowed rear panel to form a second smooth hinge joint. The first and second bowed sleeves are disposed with the first smooth hinge joint of the first bowed sleeve slidably retained adjacent to the first smooth hinge joint of the surrounding second bowed sleeve, and the second smooth hinge joint of the first bowed sleeve is slidably retained adjacent to the second smooth hinge joint of the surrounding second bowed sleeve. With this, the first and second smooth hinge joints retain the first and second bowed sleeves in accurate registration even during relative sliding between the first and second bowed sleeves.

A plurality of interposed coded images are disposed on the bowed front panel of either the first bowed sleeve or the second bowed sleeve, and a plurality of shutter elements are disposed on the bowed front panel of the bowed sleeve that does not have the plurality of interposed coded images disposed thereon. The plurality of shutter elements are disposed in alignment with the plurality of coded images for selectively obscuring the plurality of coded images. A plurality of viewing elements are interposed on the bowed front panel of the bowed sleeve that does not have the plurality of interposed coded images disposed thereon between the plurality of shutter elements.

For optimal performance, the bowed rear panels, and the first and second smooth hinge joints of the first bowed sleeve and the second bowed sleeve should be in close frictional contact so that the entire surfaces of the bowed front panels on which the plurality of coded images and the plurality of shutter elements are disposed are maintained in constant close contact and the plurality of coded images and the plurality of shutter elements are maintained in precise registration. In certain cases, this close contact can be ensured by forming the front and rear panels of the second bowed sleeve with a combined length from first edge to second edge that is between approximately one hundred percent and one hundred and two percent, preferably between approximately one hundred and one-half percent and one hundred and one and one-half percent, and most preferably approximately one hundred and six-tenths percent of a combined length from first edge to second edge of the front and rear panels of the first bowed sleeve.

In manufacture, the first and second bowed sleeves each may be formed from a sheet of flexible material folded into a sleeve with a first end fastened to a second end. Furthermore, each of the first and second bowed sleeves may further comprise a means for aligning the first end and the second end of each sheet whereby precise registration of the plurality of coded images with the plurality of shutter elements and optimal sizing of a length from first edge to second edge of the front and rear panels of the first and second bowed sleeves are ensured. The means for aligning the first end and the second end of each sheet may comprise a first registration point disposed adjacent to the first end of each sheet and a second registration point disposed adjacent to the second end of each sheet whereby the first and second registration points can be aligned during a folding of the sheets into sleeves so that the first and second ends of the sheets can be fastened together with the plurality of coded images and the plurality of shutter elements in exact alignment and each of the first and second sleeves of optimal size.

In any case, the invention's unique usefulness may be improved by having the rear panel of the second bowed sleeve further comprise a marking surface whereby a user can apply writing or other markings to the rear panel of the second bowed sleeve and the moveable display device can be employed to relay messages and the like.

Of course, one should be mindful that the foregoing discussion is designed merely to outline the more important features of the invention broadly to enable a better understanding of the detailed description that follows and to instill a better appreciation of the inventor's contribution to the art. Before an embodiment of the invention is explained in detail, it must be made dear that the following details of construction, descriptions of geometry, and illustrations of inventive concepts are mere examples of possible manifestations of the invention.

BRIEF DESCRIPTION OF THE DRAWINGS

In the accompanying drawings:

FIG. 3 is a cross-sectional view of the moveable image display device taken along the line 3—3 in FIG. 2;

FIG. 4 is a top plan view of a first flexible sheet alongside a second flexible sheet, each according to the present invention;

DETAILED DESCRIPTION OF PREFERRED EMBODIMENTS

As with many inventions, the present invention for a manually operated moveable display device can assume a wide variety of embodiments. However, to assist those reviewing the present disclosure in understanding and, in appropriate circumstances, practicing the present invention, a few particularly preferred embodiments of the moveable display device will be disclosed hereinafter.

Figure 1:
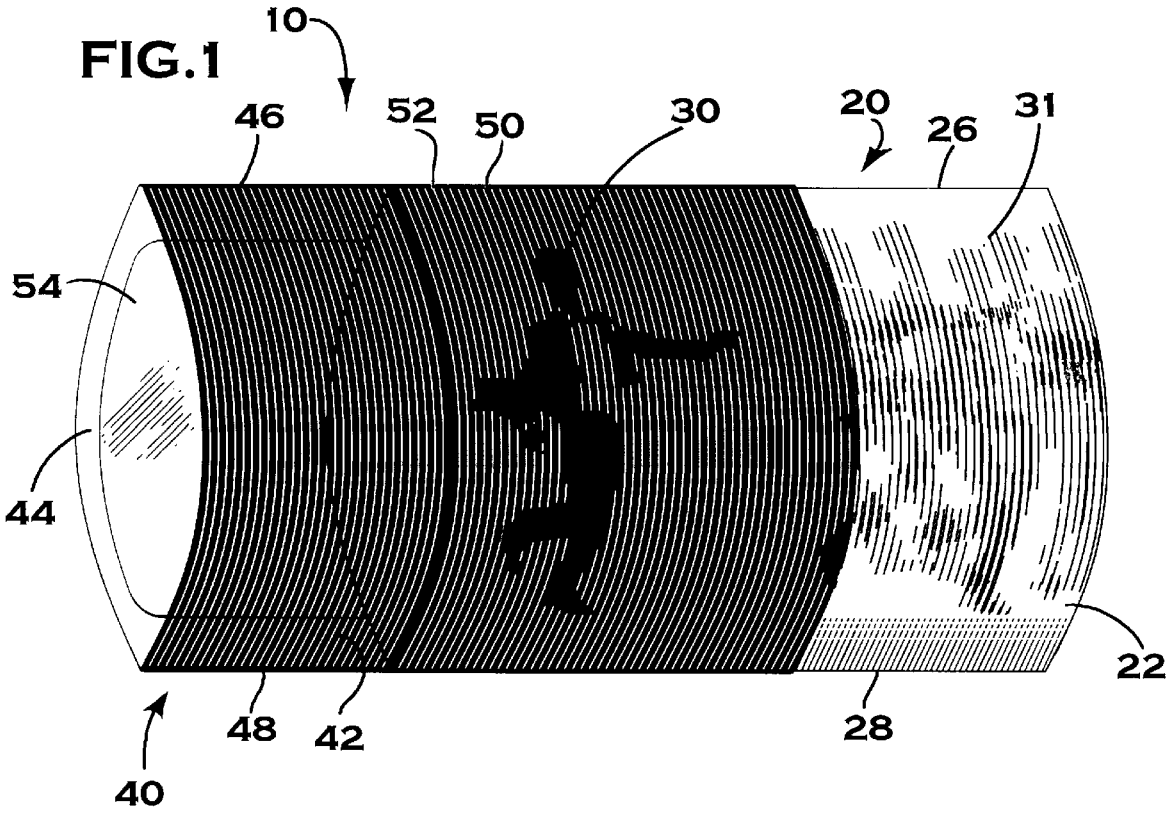
FIG. 1 is a perspective view of a preferred embodiment of the present invention for a hand-operated moveable image display device.

With this in mind and looking more particularly to the accompanying figures, one sees a preferred embodiment of the present invention for a manually operated moveable display device indicated generally at 10 in FIG. 1. The moveable display device 10 comprises a first bowed sleeve 20 that is slidably retained in close frictional contact within a second bowed sleeve 40. The first bowed sleeve 20 has a bowed front panel 22 coupled to a bowed rear panel 24, which can be seen best in FIG.2. The front and rear panels 22 and 24 are joined at first edges 26 and second edges 28 of each to form a first smooth hinge joint, also indicated at 26, and a second smooth hinge joint, also indicated at 28. Similarly, the second bowed sleeve 40 has a bowed front panel 42 coupled to a bowed rear panel 44. The front and rear panels 42 and 44 are joined at first edges 46 and second edges 48 of each to form a first smooth hinge joint, also indicated at 46, and a second smooth hinge joint, also indicated at 48.

Of course, the invention requires for its function that a plurality of interposed coded images, such as those indicated at 30, be disposed on either the first or second bowed sleeves 20 or 40 and that a plurality of shutter elements 50 for selectively obscuring the plurality of coded images 30 and selectively completing one of the plurality of coded images 30 at each given time be disposed on the first or second bowed sleeve 20 or 40 on which the coded images 30 are not disposed. As FIG. 1 depicts in a perspective view and as FIG. 3 shows in cross section, the plurality of interposed coded images 30 are formed from a plurality of narrow strips 31, each strip 31 comprising just a portion of an entire interposed coded image 30. A plurality of viewing elements 52 for selectively exposing the plurality of coded images 30 are interposed on the bowed front panel 42 of the second bowed sleeve 40. Of course, the plurality of shutter elements 50 and the plurality of viewing elements 52 are disposed in alignment with the plurality of coded images 30.

Figure 7:
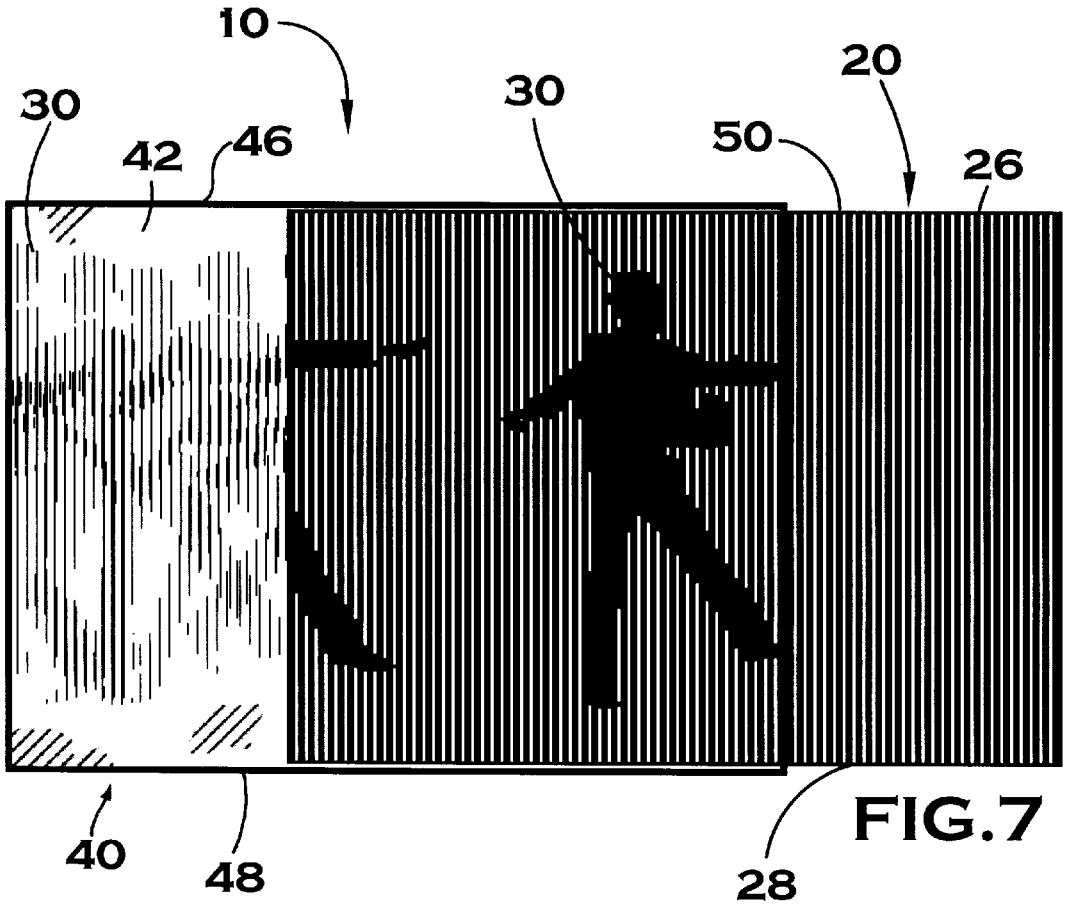
FIG. 7 is a view in front elevation of still another moveable image display device according to the present invention.

In the embodiment of the invention shown in FIGS. 1–5, the plurality of coded images 30 are disposed on the front panel 22 of the first bowed sleeve 20, and the plurality of shutter elements 50 are disposed on the front panel 42 of the second bowed sleeve 40. Of course, on Which bowed sleeve 20 or 40 the coded images 30 and the shutter elements 50 are disposed is of little consequence. For example, as FIG. 7 shows, similar advantage may be achieved by disposing the plurality of coded images 30 on the bowed front panel 42 of the second bowed sleeve 40 and disposing the plurality of shutter elements 50 on the bowed front panel 22 of the first bowed sleeve 20. Furthermore, although it has been found most preferable that the plurality of coded images 30 and the plurality of shutter elements 50 be disposed on adjacent surfaces so that they are in immediate contact, it is certainly within the scope of the present invention to dispose the coded images 30 and the shutter elements 50 on non-contacting surfaces.

Figure 5:
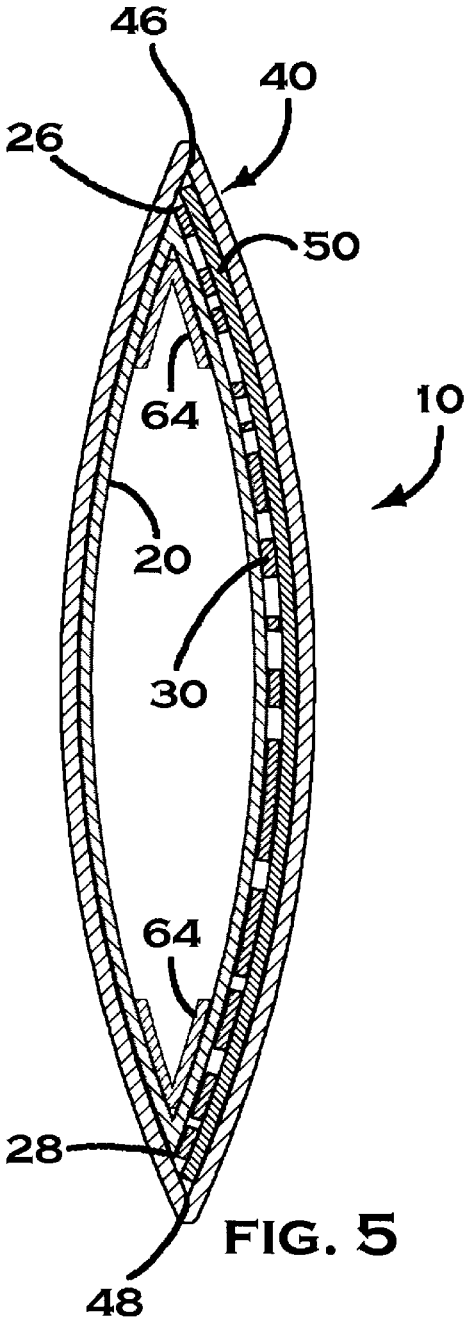
FIG. 5 is a cross-sectional view of an alternative moveable image display device.

One should note that in the cross-sectional views of the invention, such as in FIGS. 3 and 5, the coded images 30, the shutter elements 50, and the first and second bowed sleeves 20 and 40 are shown for clarity with greatly exaggerated thickness. In reality, the coded images 30 and the shutter elements 50 are of substantially negligible thickness. Any appearance, such as in FIG. 5, that the first and second smooth hinge joints 26 and 28 and 46 and 48 do not align exactly is merely the result of this greatly exaggerated thickness. In reality, the first smooth hinge joint 26 is disposed immediately adjacent to the first smooth hinge joint 46 and the second smooth hinge joint 46 is disposed immediately adjacent to the second smooth hinge joint 48.

Since the present inventor has discovered that close frictional contact between the first bowed sleeve 20 and the second bowed sleeve 40 and perfectly calibrated registration thereof will yield optimal effectiveness in achieving the combined goals of achieving accurate registration and complete surface contact, the preferred embodiment of the invention induces this close fictional contact and registration by precisely crafting the first bowed sleeve 20 and the second bowed sleeve 40 in light of the materials employed. With this precise craning, the invention ensures that the second bowed sleeve 40 is only large enough to allow the first bowed sleeve 20 to slide in close frictional contact therein. This in turn ensures that the coded images 30 and the plurality of shutter elements 50 are maintained in exceedingly accurate registration, which has been lacking historically in the prior art devices.

To ensure proper sizing and registration, the present inventor has conceived of forming the first and second bowed sleeves 20 and 40 of first and second flexible sheets of material, also indicated at 20 and 40 and, as may be seen best in FIG. 4, employing a means for aligning the ends of the first and second sheets of flexible material 20 and 40 during manufacture of the moveable display device 10. In this preferred embodiment, the aligning means comprises registration points disposed adjacent to each of the comers of each of the first and second flexible sheets 20 and 40. Stated more particularly, a first pair of registration points, each indicated at 56, is disposed adjacent to the comers of a first end of the first flexible sheet 20, and a second pair of registration points, each indicated at 58, is disposed adjacent to the comers of the second end of the first flexible sheet 20. Similarly, a first pair of registration points, each indicated at 60, is disposed adjacent to the comers of a first end of the second flexible sheet 40, and a second pair of registration points, each indicated at 62, is disposed adjacent to the comers of the second end of the second flexible sheet 40. In this preferred embodiment, the distance between the registration points of each pair of registration points 56, 58, 60, and 62 is equal.

In practice, the first and second flexible sheets 20 and 40 are formed into the first and second bowed sleeves 20 and 40 by a user's aligning the first pair of registration points 56 of the first flexible sheet 20 with the second pair of registration points 58 of the first flexible sheet 20 and fastening the ends of the first flexible sheet 20 together by, for example, adhesive (not shown) and by a user's aligning the first pair of registration points 60 of the second flexible sheet 40 with the second pair of registration points 62 of the second flexible sheet 40 and fastening the ends of the second flexible sheet 40 together by, for example, adhesive.

Although the pairs of registration points 56, 58, 60, and 62 could be aligned manually, the inventor has realized that most ideal alignment can be achieved by aligning the registration points 56, 58, 60, and 62 by employing a rigid structure (not shown) that has a pair of pins (not shown) projecting therefrom. The pins are disposed to line up exactly with and then pierce each pair of registration points 56, 58, 60, and 62.

To illustrate, a user can craft the first bowed sleeve 20 from the first flexible sheet 20 by aligning the pair of pins of the rigid structure with the first pair of registration points 56 with the coded image 30 facing the pair of pins and piercing the pair of pins through the first pair of registration points 56 of the first flexible sheet 20. The user could then roll the first flexible sheet 20 back upon itself to align the second pair of registration points 58 with the first pair of registration points 56 and the pair of pins, which are coincident. With an adhesive means, such as double-sided tape (not shown), disposed between the ends of the first flexible sheet 20, the pair of pins could be pierced through the second pair of registration points 58, and the ends of the first flexible sheet 20 could be joined whereby the first flexible sheet 20 would assume a cylindrical shape. The second flexible sheet 40 would undergo substantially the same process.

The first and second flexible sheets 20 and 40 could then be folded into halves, which then would comprise the front and rear panels 22 and 24 and 42 and 44 of the first bowed sleeve 20 and the second bowed sleeve 40. Although his folding of the first and second flexible sheets 20 and 40 could be performed while the first and second flexible sheets 20 and 40 are separate, it appears most ideal if first the first flexible sheet 20 in its cylindrical form is matingly slid into concentric engagement with the second flexible sheet 40 in its cylindrical form. With this, the first and second flexible sheets 20 and 40 could be folded into halves simultaneously in a manner that ensures that the first smooth hinge joint 26 of the first bowed sleeve 20 aligns exactly with the first smooth hinge joint 46 of the second bowed sleeve 40 and that the second smooth hinge joint 28 of the first bowed sleeve 20 aligns exactly with the second smooth hinge joint 48 of the second bowed sleeve 40. Once the first and second flexible sheets 20 and 40 are folded, they could be trimmed at their edges to remove an edgewise strip of material including the registration points 56, 58, 60, and 62. With such an exacting assembly, the invention ensures that the plurality of shutter elements 42 and the strips 31 that comprise the plurality of coded images 30 are aligned to an exacting degree that does not appear to have been obtainable by the prior art.

As a result the invention ensures exacting registration of the first bowed sleeve 20 relative to the second bowed sleeve 40 and thus the plurality of coded images 30 relative to the plurality of shutter elements 50. Most simply put, the invention provides no room for misalignment as the first bowed sleeve 20 is restrained about its entire outer surface by the inner surface of the second bowed sleeve 40. For example, the first smooth hinge joint 26 of the first bowed sleeve 20 rides closely against the first smooth hinge joint 46 of the second bowed sleeve 40 and the second smooth hinge joint 28 of the first bowed sleeve 20 rides closely against the second smooth hinge joint 48 of the second bowed sleeve 40, and misalignment is substantially eliminated.

The relative size of tie first bowed sleeve 20 relative to the second bowed sleeve 40 that is required to ensure close frictional engagement will depend in part on the materials from which the first and second bowed sleeves 20 and 40 are made. In this preferred embodiment, the bowed sleeve 20 or 40 on which the coded images 30 are disposed is formed from opaque, preferably white, material such as plastic paper, coated card stock, or the like. The bowed sleeve 20 or 40 on which the shutter elements 50 are disposed comprises a translucent material such as acetate or vellum with opaque lines disposed thereon comprising the shutter elements 50. In this preferred embodiment with the aforementioned materials, the second bowed sleeve 40 has front and rear panels 42 and 44 with a combined length of between one hundred and one hundred and two percent, preferably between one hundred and one-half and one hundred and one and one-half percent, and most preferably approximately one hundred and six-tenths percent of the combined length of the front and rear panels 22 and 24 of the first bowed sleeve 20.

This length relationship is ensured and dictated by the careful location of the registration points 56, 58, 60, and 62, which may be seen most clearly in FIG. 4. One can see that the distance between the first pair of registration points 56 and the second pair of registration points 58 of the fist flexible sheet 20 is only slightly less than the distance between the first pair of registration points 60 and the second pair of registration points 62 of the second flexible sheet 40. For example, one embodiment of the invention disposes the first pair of registration points 56 approximately 25.35 cm from the second pair of registration points 58 on the first flexible sheet 20 while on the second flexible sheet 40 the first registration points 60 are disposed approximately 25.5 cm from the second registration points 62. Of course, this invention is not limited by such particular dimensions in any way.

As has been stated previously, it is also an important advantage of this invention that close contact be maintained between substantially the entire face the front panel 22 of the first bowed sleeve 20 and substantially the entire face of the front panel 42 of the second bowed sleeves 40. With this close contacts the plurality of coded images 30 remain coherent even to a user who views the moveable display device 10 from an angle other than directly perpendicular. Although the relative sizing of the first and second sheets 20 and 40 certainly plays an important role in ensuring this dose contact, the present inventor has come to a further unique realization that a bowing of the first and second sleeves 20 and 40 also is instrumental in inducing close contact between the entire front panels 22 and 42. By the nature of the bowed arrangement and as FIG. 5 shows most clearly, no portion of the front panels 22 and 42 suffers from a lack of contact as might happen with a non-bowed arrangement.

Advantageously, when the first and second bowed sleeves 20 and 40 are formed from properly chosen materials, the first and second smooth hinge joints 26 and 28 and 46 and 48 act as means for resiliently biasing the front and rear panels 22 and 24 and 42 and 44 to a bowed condition. For example, when one of the first and second bowed sleeves 20 or 40 is formed from plastic paper or coated card stock the other is formed from acetate or vellum, no additional means for biasing the first and second bowed sleeves 20 or 40 is generally necessary. Of course, where other materials are used or Where additional assurance of bowing is desired, an alternative or additional means for biasing the first and second bowed sleeves 20 and 40 into a bowed condition may be desired. For example, suitable biasing means may comprise one or more resilient wedges comprising, for example, a strip of plastic tape 64 as is shown in FIG. 5, one or more spring members (not shown), or any other suitable means.

This arrangement allows the moveable display device 10 to display more images than devices of the prior art. For example, while prior art devices have been able to display just 2, 3, and, possibly, 4 images with varying degrees of success, the present invention is able to display 6, 7, 8, 9, and even more images in an exceedingly coherent manner with substantially no misalignment that might otherwise lead to overlap or "cross-talk" between adjacent coded images 30. For example, in the preferred embodiment of the invention shown in the figures, each of the shutter elements 50 conceals five coded images 30 at any given time while the viewing elements 52 selectively reveal one, and only one, coded image 30. As has been made clear previously, that revealed coded image 30 is completed by the plurality of shutter elements 50 to give the appearance of a complete image.

A user can operate the moveable display device 10 by sliding the first bowed sleeve 20 relative to the second bowed sleeve 40 by, for example, placing the tip of his or her index finger on the outer surface of the rear panel 44 of the second bowed sleeve 40, placing his or her thumb on the inner surface of the rear panel 24 of the first bowed sleeve 20, and using his or her thumb and index finger to slide the first and second bowed sleeves 20 and 40 relative to one another. With his, six different coded images 30 may be displayed sequentially with one coded image 30 at a time being revealed by the plurality of viewing elements 52 as it is simultaneously completed by the plurality of shutter elements 50.

Although dimensions may be readily varied and this invention is in no way limited to any particular dimensions or number of coded images 30, it may be useful to note that one preferred embodiment of the moveable display device 10 has shutter elements 50 each with a width of approximately 0.075 inches (0.191 cm), viewing elements 52 each with a width of approximately 0.010 inches (0.025 cm), and coded images 30 with strips 31 each with a width of approximately 0.015 inches (0.038 cm). One recalling the simple formula set forth earlier in this patent will see that the number of displayed coded images 30 equals one plus the result of dividing 0.075 inches, the width of the shutter elements 50, by 0.015 inches, the width of the strips 31 of the coded images 30. As such, one sees that the present invention achieves the mathematical limit regarding the number of coded images 30 that a moveable display device 10 can display while the invention resists suffering from the practical limitations of misalignment and lack of surface contact that have plagued prior art devices.

Figure 2:
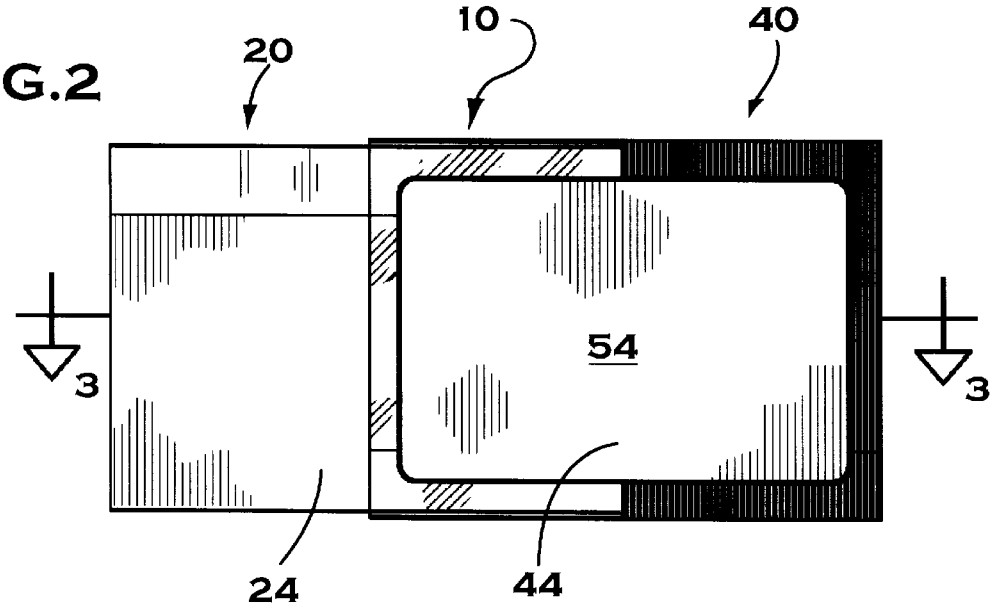
FIG. 2 is a view in rear elevation of the moveable image display device of FIG. 1.

As is shown most clearly in FIG. 2, the invention's exceptional ability to provide accurate registration and fill surface contact between the plurality of coded images 30 and the plurality of shutter elements 50 is supplemented by the inclusion of a marking surface 54 on the rear panel 44 of the second bowed sleeve 40. Of course, the marking surface 54 may assume a wide variety of forms while still remaining within the scope of this invention. In the present embodiment, however, the marking surface 54 comprises an appropriately sized adhesive label that is affixed to the rear panel 44 of the second bowed sleeve 50. With such a marking surface 54 available, a user can apply writing or other markings to the rear panel 44 of the second bowed sleeve 50 and the moveable display device 10 can be employed to relay messages and the like. One may note here that the resilient biasing of the first and second bowed sleeves 20 and 40 provides a further advantage in that it allows a user to press the first and second bowed sleeves 20 and 40 flat while still inducing them to return to a bowed condition upon removal of the flattening force. The marking surface 54 and the resiliency of the moveable display device 10 are extremely useful where, for example, the moveable display device 10 is to be used as a greeting card or the like and it is to be mailed in a traditional envelope (not shown).

It is important to remain mindful that the configuration of the moveable display device 10 depicted in FIGS. 1–5 and 7 comprises just one of many possible manifestations of the present invention. By way of example, an alternative embodiment of the present invention for a moveable display device is again indicated generally at 10 in FIG. 6. In this embodiment, an inner panel 80 is slidably retained by a bowed outer panel 86. The bowed outer panel 86 comprises a substantially rigid member of, for example, plastic that independently maintains a bowed or arcuate shape. In a manner similar to the previous embodiments of the invention, the inner panel 80 has a plurality of coded images 81 disposed thereon While a plurality of shutter elements 83 are disposed on the outer panel 86. As a result, the inner panel 80 might aptly be termed an image member while the outer panel 86 might be termed a shutter member.

Figure 6:
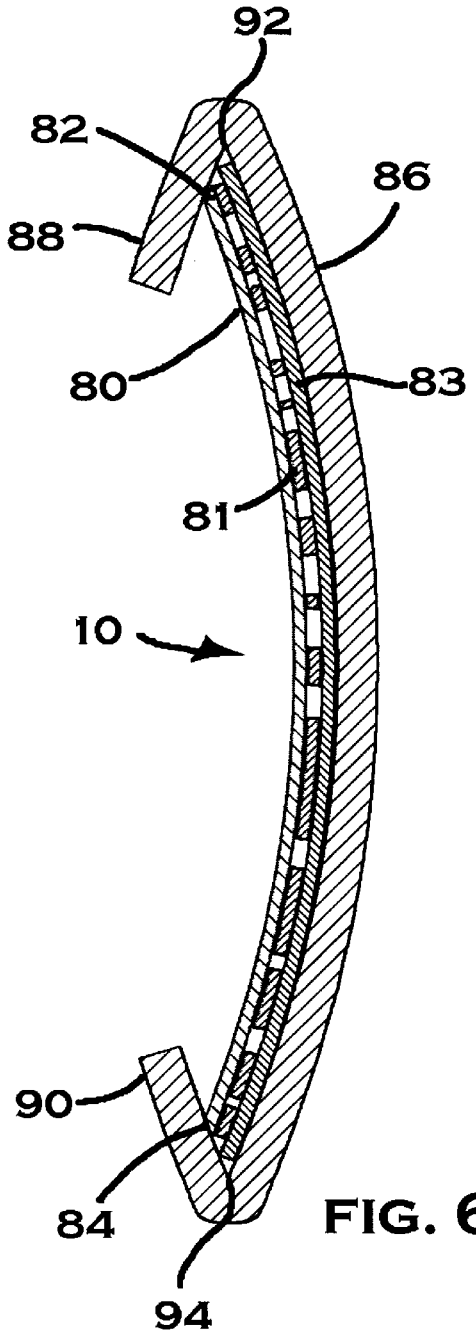
FIG. 6 is a cross-sectional view of another alternative moveable image display device according to the present invention.

A first restrictive shoulder surface 88 projects from a first edge 92 of the outer panel 86 immediately distal to a first edge 82 of the inner panel 80 and a second restrictive shoulder surface 90 projects from a second edge 94 of the outer panel 86 immediately distal to a second edge 84 of the inner panel 80. With this, it becomes dear that the first and second restrictive shoulder surfaces 88 and 90 comprise means for applying a constant force to at least a portion of each of the first and second edges 82 and 84 of the inner panel 80. As such, the first and second restrictive shoulder surfaces 88 and 90 constantly press the entire surface of the inner panel 80 into contact aim the entire surface of the outer panel 86. The first and second restrictive shoulder surfaces 88 and 90 also act as means for maintaining the first edge 82 of the inner panel 80 in a substantially parallel relationship with the first edge 92 of the outer panel 86 and the second edge 84 in a substantially parallel relationship with the second edge 94 of the outer panel 86. In practice, the first edge 82 of the inner panel 80 will be disposed immediately adjacent to the first edge 92 of the outer panel 86, and the second edge 84 of the inner panel 80 will be disposed immediately adjacent to the second edge 94 of the outer panel 86. That this is not precisely shown in FIG. 6 is due only to the exaggerated thicknesses of the coded images 81 and the shutter elements 83.

In light of the above, it becomes clear that the present invention achieves a plurality of advantages over prior art moveable display devices. For example, the moveable display device 10 maintains exceptionally accurate registration and exceedingly constantly close contact of the plurality of shutter elements 50 relative to the plurality of coded images 30. As a result, the invention is able to display a large plurality of sharp and intricate coded images 30 that change from one to another in a fluidic manner. Of course, it a further advantage of the invention that it is manually operable and that it can be pressed flat for use as a greeting card or the like. Still further, another very useful advantage of the invention is that it accomplishes all of the aforementioned goals in a moveable display device 10 that is exceedingly simple in use, structure, and manufacture. Undoubtedly, these and other objects and advantages of the invention will be readily apparent to one who reviews the present specification and drawings and also to one who has the opportunity to enjoy the use of an embodiment of the present invention for a manually-operated moveable display device 10.

Although the invention for a moveable display device 10 has been shown and described with reference to certain preferred embodiments, those skilled in the art undoubtedly will find alternative embodiments obvious after reading this disclosure. With this in mind, the following claims are intended to define the scope of protection to be afforded to the inventor, and those claims shall be deemed to include equivalent constructions insofar as they do not depart from the spirit and scope of the present invention.

I claim as deserving the protection of United States Letters Patent:

1. A manually operated moveable display device for displaying a plurality of images, the moveable display device comprising:

an image member comprising an image panel with a first edge and a second edge;

a plurality of interposed coded images disposed on the image panel of the image member;

a shutter member comprising a shutter panel slidably retained adjacent to tie image panel of the image member wherein the shutter panel has a first edge and a second edge;

a plurality of shutter elements disposed on the shutter panel for alignment with the coded images on the image panel of the image member for selectively obscuring the coded images on the image panel of the image member;

a plurality of viewing elements interposed between the plurality of shutter elements for selectively exposing the coded images of the image panel of the image member;

a means for maintaining the first edge of the image panel of the image member and the first edge of the shutter panel of the shutter member in a substantially parallel relationship;

a means for maintaining die second edge of the image panel of the image member and the second edge of the shutter panel of the shutter member in a substantially parallel relationship;

a means for biasing the image panel of the image member and the shutter panel of the shutter member into a bowed condition with a bow generally perpendicular to the fist and second edges of the image panel and the shutter panel whereby either the image panel or the shutter panel comprises an inner panel and the other panel comprises an outer panel;

a means for biasing the image panel of the image member and the shutter panel of the shutter member into contact;

whereby the manually-operated moveable display device displays a plurality of coded images in response to a movement of the shutter panel relative to the image panel while tie plurality of coded images of the image panel and the plurality of shutter elements of the shutter panel are maintained in accurate registration during such relative movement.

2. The moveable display device of claim 1 wherein the means for biasing the image panel of the image member and the shutter panel of the shutter member into contact comprises a means for applying a constant force to at least a portion of the first edge and the second edge of the inner panel thereby to press the inner panel into constant contact with the outer panel.

3. The moveable display device of claim 2 wherein the means for applying a constant force comprises a first restrictive member projecting from the first edge of the outer member immediately distal to the first edge of the inner member and a second restrictive member projecting from the second edge of the outer member immediately distal to the second edge of the inner member whereby the first and second restrictive members trap the inner member to exert a constant compressive force on the inner member to bias the inner member into constant close contact with the outer member.

4. The moveable display device of claim 3 wherein the first restrictive member comprises a shoulder surface of a given length projecting from the first edge of the outer member and wherein the second restrictive member comprises a shoulder surface of a given length projecting from the second edge of the outer member.

5. The moveable display device of claim 4 wherein the outer panel is generally rigid whereby the outer panel comprises the means for biasing the image panel of the image member and the shutter panel of the shutter member into a bowed condition.

6. The moveable display device of claim 3 further comprising a rear panel with a first edge coupled to the first edge of the outer panel to form a first smooth hinge joint and a second edge coupled to the second edge of the outer panel to form a second smooth hinge joint whereby the outer panel and the rear panel together form a sleeve that surrounds tie inner member and whereby the first and second smooth hinge joints and the rear panel comprise the first and second restrictive members.

7. The moveable display device of claim 6 further comprising a means for biasing the rear panel into a bowed condition.

8. The moveable display device of claim 7 wherein the first and second smooth hinge joints are biased toward an open condition whereby the first and second smooth hinge joints comprise the means for biasing the image panel of the image member and the shutter panel of the shutter member into a bowed condition and the means for biasing the rear panel into a bowed condition.

9. The moveable display device of claim 7 wherein the means for biasing the image panel of the image member and the shutter panel of the shutter member into a bowed condition and the means for biasing the rear panel into a bowed condition comprise a first resilient wedge disposed adjacent to die first smooth hinge joint and a second resilient wedge disposed adjacent to the second smooth hinge joint.

10. A manually operated moveable display device for displaying a plurality of images, the moveable display device comprising:

a first sleeve comprising a front panel coupled at a first edge to a first edge of a rear panel to form a first smooth hinge joint and coupled at a second edge to a second edge of the rear panel to form a second smooth hinge joint;

a second sleeve for slidably surrounding the first sleeve, the second sleeve comprising a front panel coupled at a first edge to a first edge of a rear panel to form a first smooth hinge joint and coupled at a second edge to a second edge of the rear panel to form a second smooth hinge joint wherein the first smooth hinge joint of the first sleeve is slidably retained adjacent to the first smooth hinge joint of the surrounding second sleeve and the second smooth hinge joint of the first sleeve is slidably retained adjacent to the second smooth hinge joint of the surrounding second sleeve whereby the first and second smooth hinge joints of the first and second sleeves retain the first and second sleeves in accurate registration even during relative sliding between the first and second sleeves;

a plurality of interposed coded images disposed on the front panel of either the first sleeve or the second sleeve;

a plurality of shutter elements disposed on the front panel of the sleeve that does not have the plurality of interposed coded images disposed thereon wherein the plurality of shutter elements are disposed in alignment with the plurality of coded images for selectively obscuring the plurality of coded images;

a plurality of viewing elements for selectively exposing the plurality of coded images wherein the plurality of viewing elements are interposed on the front panel of the sleeve that does not have the plurality of interposed coded images disposed thereon between the plurality of shutter elements;

whereby the manually-operated moveable display device displays a plurality of coded images in response to a sliding of the first sleeve relative to the second sleeve while the plurality of coded images and the plurality of shutter elements are maintained in accurate registration during such relative sliding.

11. The moveable display device of claim 10 wherein the plurality of coded images are disposed on tile front panel of the first sleeve and the plurality of shutter elements are disposed on the front panel of the second sleeve.

12. The moveable display device of claim 10 wherein the plurality of coded images are disposed on the front panel of tie second sleeve and the plurality of shutter elements are disposed on the front panel of the first sleeve.

13. The moveable display device of claim 10 wherein the front panels, the rear panels, and the first and second smooth hinge joints of the first sleeve and tile second sleeve are in dose frictional contact whereby the plurality of coded images and the plurality of shutter elements are maintained in precise registration.

14. The moveable display device of claim 13 wherein the front and rear panels of the second sleeve have a combined length from first edge to second edge that is between approximately one hundred percent and one hundred and two percent of a combined length from first edge to second edge of the front and rear panels of the first sleeve.

15. The moveable display device of claim 14 wherein the front and rear panels of the second sleeve have a combined length from first edge to second edge that is between approximately one hundred and one-half percent and one hundred and one and one-half percent of a combined length from first edge to second edge of the front and rear panels of the first sleeve.

16. The moveable display device of claim 10 wherein the front and rear panels of the first sleeve and the front and rear panels of the second sleeve are bowed whereby the first sleeve comprises a first bowed sleeve and the second sleeve comprises a second bowed sleeve.

17. The moveable display device of claim 16 wherein the front panels, the rear panels, and the first and second smooth hinge joints of the first sleeve and the second sleeve are in close frictional contact whereby the plurality of coded images and the plurality of shutter elements are maintained in precise registration and entire surfaces of the front panels on which the plurality of coded images and the plurality of shutter elements are disposed are maintained in constant close contact.

18. The moveable display device of claim 10 wherein the first sleeve and the second sleeve each comprise a sheet of flexible material folded into a sleeve with a first end fastened to a second end and wherein each of the first and second sleeves further comprises a means for aligning the first end and the second end of each sheet whereby precise registration of the plurality of coded images with the plurality of shutter elements and optimal sizing of a length from first edge to second edge of the front and rear panels of the first and second sleeves are ensured.

19. The moveable display device of claim 18 wherein the means for aligning the first end and the second end of each sheet comprises a first registration point disposed adjacent to the first end of each sheet and a second registration point disposed adjacent to the second end of each sheet whereby the first and second registration points can be aligned during a folding of the sheets into sleeves so that the first and second ends of the sheets can be fastened together with the plurality of coded images and the plurality of shutter elements in exact alignment and each of the first and second sleeves of optimal size.

20. The moveable display device of claim 10 wherein the rear panel of the second sleeve further comprises a marking surface whereby a user can apply writing or other markings to the rear panel of the second sleeve and the moveable display device can be employed to relay messages and the like.

* * * * *